US008574033B2

(12) United States Patent
Sung

(10) Patent No.: US 8,574,033 B2
(45) Date of Patent: Nov. 5, 2013

(54) WAFER SUPPORT MEMBER, METHOD FOR MANUFACTURING THE SAME AND WAFER POLISHING UNIT COMPRISING THE SAME

(75) Inventor: Jae Chel Sung, Gumi-si (KR)

(73) Assignee: LG Siltron Inc., Gumi, Gyeongsangbukpdo (KR)

( * ) Notice: Subject to any disclaimer, the term of this patent is extended or adjusted under 35 U.S.C. 154(b) by 431 days.

(21) Appl. No.: 12/899,131

(22) Filed: Oct. 6, 2010

(65) Prior Publication Data

US 2011/0081841 A1 Apr. 7, 2011

(30) Foreign Application Priority Data

Oct. 7, 2009 (KR) ..... 10-2009-0095195
Sep. 16, 2010 (KR) ..... 10-2010-0091172

(51) Int. Cl.
*B24B 1/00* (2006.01)

(52) U.S. Cl.
USPC ..... 451/67; 451/286; 451/364; 451/398

(58) Field of Classification Search
USPC ..... 451/285–289, 364, 398, 67, 64; 156/280; 269/289 R
See application file for complete search history.

(56) References Cited

U.S. PATENT DOCUMENTS 5,944,590 A * 8/1999 Isobe et al. ..... 451/288
6,019,670 A * 2/2000 Cheng et al. ..... 451/56
6,110,025 A * 8/2000 Williams et al. ..... 451/286
6,110,026 A * 8/2000 Arai ..... 451/289
6,116,992 A * 9/2000 Prince ..... 451/286
6,273,803 B1 * 8/2001 Wang et al. ..... 451/288
6,277,008 B1 * 8/2001 Masuta et al. ..... 451/286
6,280,306 B1 * 8/2001 Hosoki et al. ..... 451/288
6,354,928 B1 * 3/2002 Crevasse et al. ..... 451/397
6,368,189 B1 * 4/2002 Maloney et al. ..... 451/41
6,390,904 B1 * 5/2002 Gleason et al. ..... 451/286
6,652,368 B2 * 11/2003 Shendon et al. ..... 451/288
6,712,673 B2 * 3/2004 Albrecht et al. ..... 451/41
6,719,874 B1 * 4/2004 Gotkis et al. ..... 156/345.14
6,835,125 B1 * 12/2004 Tseng et al. ..... 451/398
7,344,434 B2 * 3/2008 Chen et al. ..... 451/285
2009/0211533 A1 * 8/2009 Sprung ..... 119/264

FOREIGN PATENT DOCUMENTS

KR 10-0151102 B1 10/1998
KR 10-0301646 B1 9/2001
KR 10-0419135 B1 2/2004
KR 10-2004-0031071 A 4/2004
KR 10-0550034 B1 2/2006
KR 10-0884236 B1 2/2009

* cited by examiner

*Primary Examiner* — George Nguyen
(74) *Attorney, Agent, or Firm* — KED & Associates, LLP

(57) ABSTRACT

Disclosed is a wafer support member including a base substrate, a support adhered at a predetermined width to the edge of the base substrate, the support having a round outermost part, and a coating layer provided on the outermost edge of the support.

14 Claims, 4 Drawing Sheets

WAFER SUPPORT MEMBER, METHOD FOR MANUFACTURING THE SAME AND WAFER POLISHING UNIT COMPRISING THE SAME

This application claims the benefit of Korean Patent Application No. 10-2009-0095195, filed on Oct. 7, 2009 and No. 10-2010-0091172, filed on Sep. 16, 2010, which is hereby incorporated by reference as if fully set forth herein.

BACKGROUND OF THE INVENTION

1. Field of the Invention

The present invention relates to a wafer polishing machine. More specifically, the present invention relates to a pad-in template assembly which contacts a wafer during the final polishing process in the fabrication of silicon wafers for semiconductor devices.

2. Discussion of the Related Art

Wafers are generally used in the fabrication of semiconductor devices. A wafer is a circular plate formed by thinly slicing an ingot in which a silicon crystal as a semiconductor material is grown on the circumference thereof.

In the fabrication of silicon wafers for semiconductor devices, cylindrical silicon (ingot) is cut (sliced) into separate wafers. At this time, the surface of the cut wafer is protruded or grooved. Accordingly, polishing is required to planarize the wafers.

A wafer polishing machine comprises a surface plate, a mounting block, a polishing unit head, a central guide and a peripheral guide. While the polishing unit rotates, the wafer is polished via the interaction of a polishing cloth and a polishing solution provided on the surface plate.

At this time, pressurization of the polishing unit onto the wafer is as follows.

A wafer is provided on a wafer support member, e.g., template assembly and the wafer support member is adhered to the mounting block. While the polishing unit applies a predetermined pressure to the mounting block and rotates at the same time, it generates friction between the wafer and the polishing cloth and thus evenly polishes the surface of the wafer to produce a mirror finish.

The template assembly is used in the final wafer polishing process.

FIG. 1 is a view illustrating a conventional wafer support member. Hereinafter, the conventional wafer support member will be illustrated with reference to FIG. 1.

As mentioned above, the conventional wafer support member has a structure in which an epoxy glass 110 is laminated at the edge of a back material 120. Since a plurality of layers are laminated on the epoxy glass 110, the wafer support member serves as a retainer ring to guide and support such that the wafer is not separated from the head in the wafer polishing process.

However, the conventional wafer support member has the following problems.

FIG. 2A is a view illustrating the front surface of a polished wafer.

The front surface of the wafer is measured using an LLS measurement apparatus, SP2, after polishing. And, as shown in FIG. 2A, ARC typed fine scratches are present on the front surface of the wafer. The scratches are caused by fine glass fibers and foreign materials from the edge of the wafer support member.

FIG. 2B is a detailed view illustrating scratches present on the front surface of the wafer. As a result of detecting the front surface of the wafer using AFM, shallow scratches having a depth of 0.2 to 0.4 nm and a width of 300 to 600 nm were observed.

SUMMARY OF THE INVENTION

Accordingly, the present invention is directed to a wafer support member, a method for manufacturing the same and a wafer pressing unit comprising the same that substantially obviate one or more problems due to limitations and disadvantages of the related art.

It is one object of the present invention to prevent damage to the front surface of a wafer during wafer polishing.

To achieve these objects and other advantages and in accordance with the purpose of the invention, as embodied and broadly described herein, provided is a wafer support member including: a base substrate; a support adhered at a predetermined width to the edge of the base substrate, the support having a round outermost part; and a coating layer provided on the outermost edge of the support.

In accordance with another aspect, provided is a wafer polishing unit including: a wafer support member to support a wafer; a pressurizing unit to apply pressure to the wafer support member; and a pressure-supplying unit to supply pressure to the pressurizing unit, wherein the wafer support member includes a base substrate, a support adhered at a predetermined width to the edge of the base substrate, the support having a round outermost part and a coating layer provided on the outermost edge of the support.

The coating layer may be an epoxy coating layer.

The coating layer may be composed of a mixture of epoxy and a polymer at a weight ratio of 2:1 to 4:1.

The coating layer may be provided to a thickness of 0.2 to 0.5 mm on the outermost edge of the round support.

The coating layer may be wider than the round part of the support.

A ratio of the width of the coating layer to the width of the round part of the support may be 1.4:1 to 1.6:1.

The coating layer may be further provided to a thickness of 0.1 to 0.3 mm in the non-round part of the support.

In accordance with another aspect, provided is a method for manufacturing a wafer support member including: laminating a support including a plurality of layers at the edge of a base substrate; rounding the edge of the support; and coating the round support.

The coating may be carried out by applying a mixture of epoxy and a polymer at a ratio of 2:1 to 4:1, followed by drying.

The drying may be carried out by primarily drying the material at 45° C. or higher and secondarily drying the material at ambient temperature.

The coating may be carried out by applying a material containing epoxy and a polymer to a thickness of 0.2 to 0.5 mm to the round part of the edge of the support.

In the coating process, the material may be applied to a 1.4- to 1.6-fold width of the width of the round part of the support.

In the coating process, the material containing epoxy and a polymer may be applied to a thickness of 0.1 to 0.3 mm to the non-round part of the edge of the support.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings:

FIGS. 2A to 25 are views illustrating the front surface of a polished wafer;

FIG. 3 is a view illustrating a wafer polishing unit according to one embodiment;

FIG. 5 is a view illustrating the width and thickness of the wafer support member according to one embodiment.

DETAILED DESCRIPTION OF THE INVENTION

Figure 1:
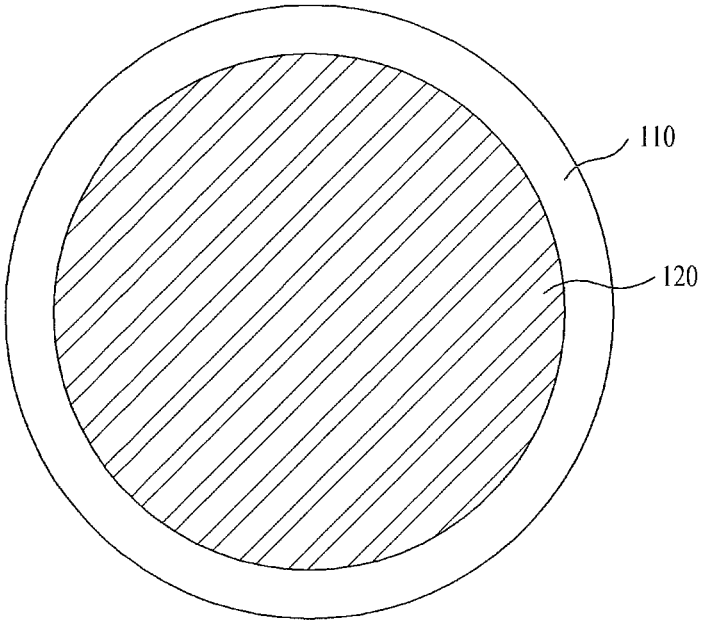
FIG. 1 is a view illustrating a conventional wafer support member.
Figure 2A:
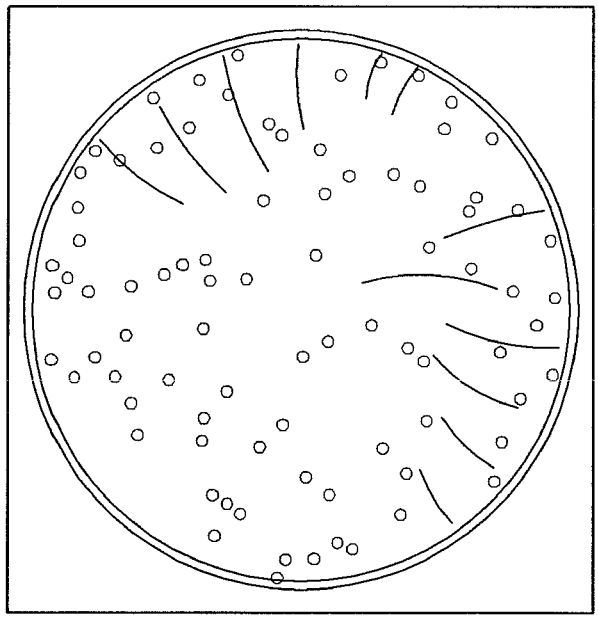
Figure 2B:
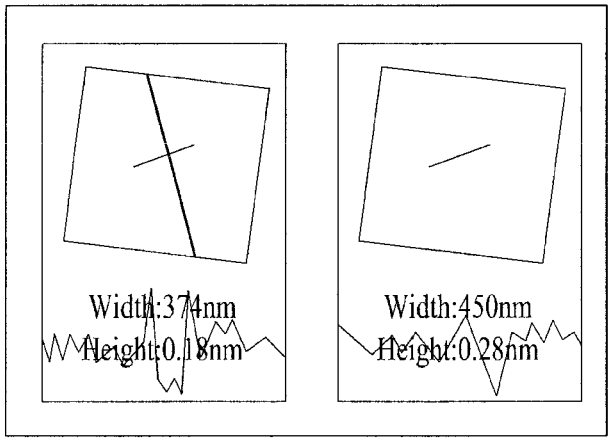

In the description of embodiments, it will be understood that when a layer (or film), a region, a pad, a pattern or a structure are referred to as being 'on/under' another layer, region, pad, pattern or substrate, it can be directly on another layer, region, pad, pattern or substrate, or one or more intervening layers, regions, pads, patterns or structures may also be indirectly present. Also, "on/under" each layer is illustrated based on the drawings.

In the drawings, the thickness or size of layers are exaggerated, omitted or schematically shown for better understanding and clarity. Also, the size of the elements may be different from an actual size thereof.

Hereinafter, a wafer support member, a method for fabricating the same and a wafer polishing unit comprising the same will be described with reference to the annexed drawings.

Figure 3:
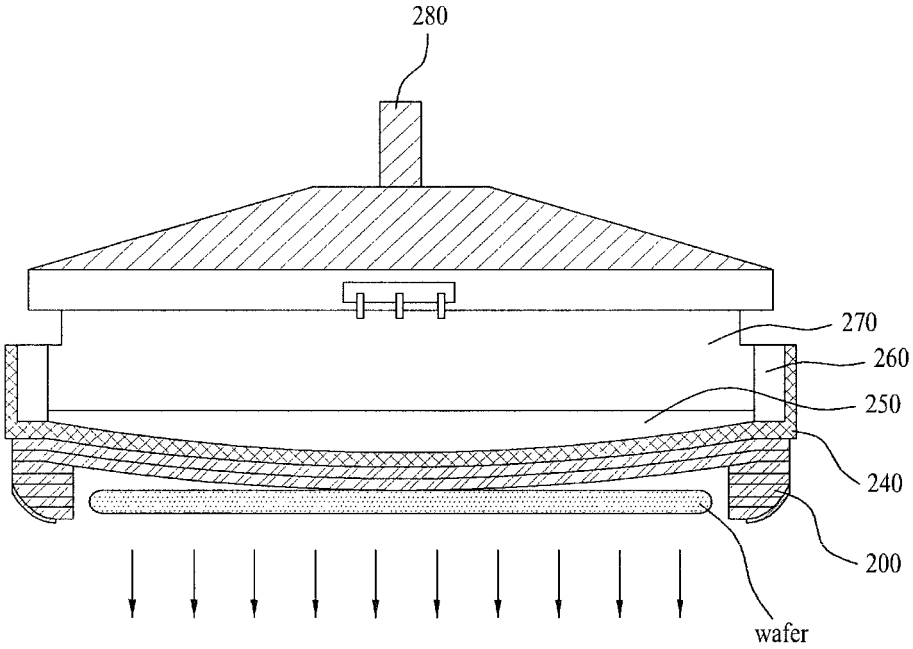

FIG. 3 is a view illustrating a wafer polishing unit according to one embodiment.

The wafer polishing unit includes a chamber 250, a pressure-supplying unit, a pressurizing unit, a wafer support member 200 and a fixing element 260, and may work as a pressing head.

The pressurizing unit includes an expansion element 240 and the expansion element 240 may undergo variations in thickness and receive pressure and thus optionally expand.

The chamber 250 forms a predetermined space with a back plate 270, an expansion element 240 and a fixing element 260. Pneumatic pressure is supplied from the pressure-supplying unit to the chamber 250 and the supplied pressure may vary the volume of the chamber 250.

The pressure-supplying unit includes a pneumatic line 280 and a back plate 270. The back plate 270 has a round circular shape, which corresponds to the wafer. The pneumatic line 280 passes through the center of the back plate 270 and extends to the chamber 250, thus being capable of transferring the pneumatic pressure to the chamber 250.

The pressurizing unit applies pneumatic pressure supplied to the chamber 250 to the wafer fixed in the wafer support member 200 and includes the expansion element 240. The expansion element 240 is made of a flexible material, which may be expanded by the pressure supplied through the pneumatic line 280 to the chamber 250.

The expansion element 240 may be made of rubber and the edge thereof is fixed by the fixing element 260. Accordingly, the edge of the expansion element 240 may be thinner than the periphery thereof, since it is disadvantageously in view of expansion.

The one surface of the wafer support member 200 contacts the expansion element 240 and the other surface thereof contacts the wafer. The wafer support member 200 receives pressure from the expansion element 240 and thus applies the pressure to the wafer.

The fixing element 260 is arranged on the circumference of the back plate 270. The fixing element 260 fixes the edge of the expansion element 240. For this reason, the expansion element 260 can be secured to the wafer polishing unit, during expansion, and can maintain the pneumatic pressure in the chamber 250.

FIGS. 4A to 4D are views illustrating a method for manufacturing a wafer support member according to one embodiment. Hereinafter, the method for manufacturing a wafer support member according to one embodiment will be illustrated with reference to FIGS. 4A to 4D.

Figure 4A:
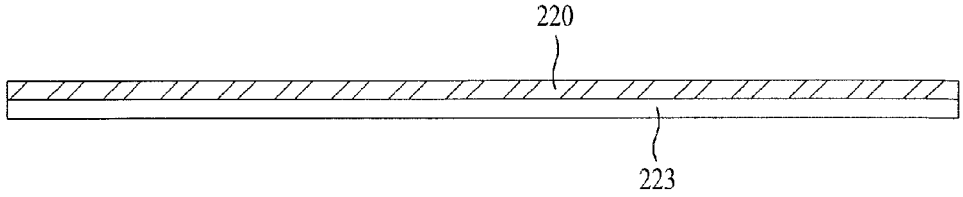
FIGS. 4A to 4D are views illustrating a method for manufacturing a wafer support member according to one embodiment.

First, as shown in FIG. 4A, a base substrate 220 is prepared. The base substrate 220 acts to support the wafer during the wafer polishing process. An adhesive agent 223 may be provided on the first surface of the base substrate 220 to adhere the wafer support member to the polishing unit in the following wafer polishing process.

A double-sided adhesive agent may be used as the adhesive agent 230. The base substrate 220 is provided at one surface thereof with the adhesive agent 223 and at the other surface thereof with a wafer in the following process.

The base substrate 220 may have the shape of a disc. For this reason, the base substrate 220 serves to support the disc-shaped wafer. The diameter of the base substrate 220 may be greater than that of the wafer.

Figure 4B:
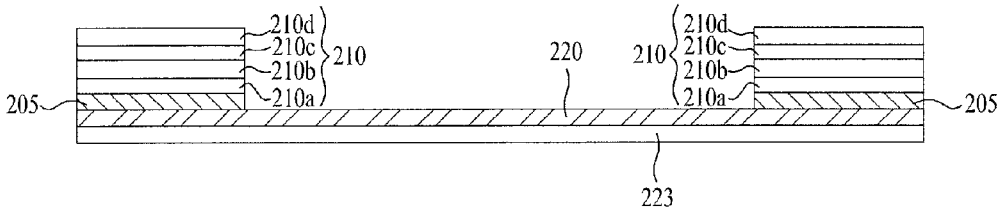

Then, as shown in FIG. 4B, a support 210 is laminated on the edge of the base substrate 220. The support 210 may be composed of an epoxy glass.

The support 210 is composed of a laminate including a plurality of layers 210*a*, 210*b*, 210*c* and 210*d*, thus obtaining a sufficient thickness. The support 210 is fixed on the base substrate 220 via an adhesive material 205. A hot melt sheet may be used as the adhesive material 205.

The support 210 guides and supports the wafer such that the wafer is not separated from the head during the wafer polishing process. Accordingly, the support 210 may be adhered at a predetermined width to the periphery of the base substrate 220. An inner radius of the support 210 should be of a sufficient size to allow the wafer to be placed in the support 210.

Figure 4C:
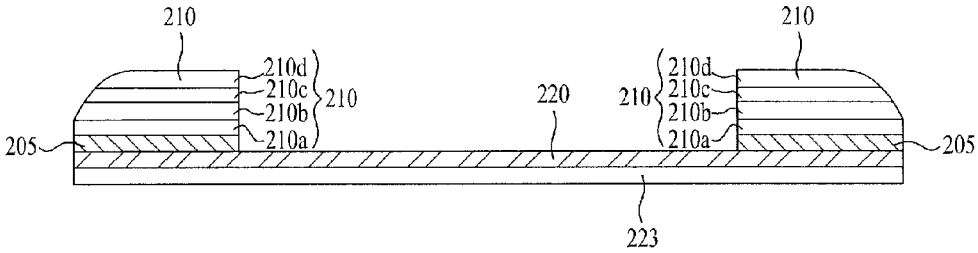

Then, as shown in FIG. 4C, the edge of the support 210 is rounded. That is, as shown in the drawing, the edge of the top of the support 210 laminated on the base substrate 220 is smoothly rounded. As used herein, the term "edge" refers to a part opposite to a region contacting the wafer.

The rounding process will be illustrated in detail.

First, the peripheral top of the support 210 is primarily polished by a method using sand paper, etc. At this time, a part of the support 210 not to be processed may be protected using a mask (not shown).

In addition, after the polishing process, the remaining sand is removed through a process such as air cleaning.

The part of the support 210, having been subjected to the primary polishing process, has a rough surface, thus requiring a smoothing process. The part polished in the afore-mentioned primary polishing process is secondarily polished by a method such as rubbing.

The support is rounded through the primary polishing process and is smoothed through the secondary polishing process. Also, the residue present on the surface of the support after the secondary polishing process is thoroughly removed by cleaning with, for example, DIW.

Figure 4D:
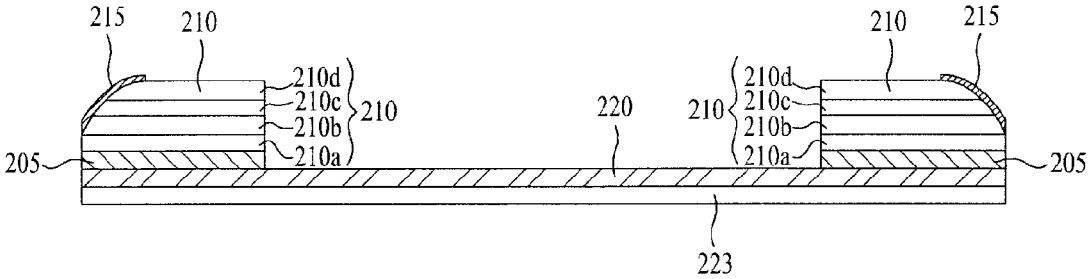

Then, as shown in FIG. 4D, the rounded edge of the support 210 is coated. That is, the support 210 is coated to remove small amounts of impurities and etched materials left on the support 210 after primary and secondary polishing, air cleaning and DIW cleaning, make the polished rough part smooth and thus prevent damage to the polishing pad. A coating layer 215 may be coated on the outermost layer of the support 210.

The coating material used herein may be epoxy. A predetermined ratio of epoxy as the coating material should be applied to the rounded part and be cured and dried under specific conditions. When the epoxy is not mixed at a predetermined ratio, the coating layer 215 may not be cured to a desired level and may flow or foam, depending on the drying method.

The coating process will be illustrated in detail.

First, a coating material is prepared. The coating material may be a mixture of epoxy and a polymer in a ratio of 10 to 3. The polymer used herein was a polymer (Toyo, Co., LTD.). The ratio of epoxy to polymer is preferably within a range of 2:1 to 4:1.

When the coating material is applied, organic material is removed from the coating material. In this embodiment, the doped coating material is primarily dried at room temperature to 45° C. or higher and is secondarily dried at room temperature. In the primary drying process, baking is mainly performed, the organic material present in the coating material is removed. And the coating material is cured in the secondary drying process.

When the coating material is dried at an excessively low temperature, the epoxy is not sufficiently cured, and when the coating material is dried at an excessively high temperature, the adhesive material 205 may be detached.

The coating layer 215 is formed on the periphery of the support 210 and the width and thickness thereof will be illustrated with reference to FIG. 5.

Figure 5:
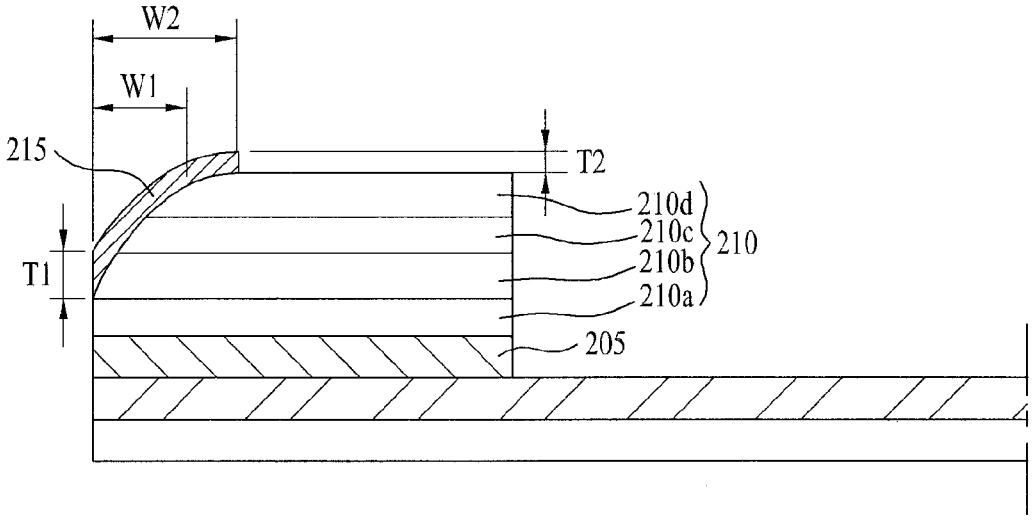

As shown in FIG. 5, the edge of the uppermost layer of the support 210 is rounded through the polishing process. The coating layer 215 may be laminated to a thickness of 0.2 mm to 0.5 mm at the rounded edge of the support 210.

When the thickness of the coating layer 215 is less than 0.2 mm, the coating layer 215 may be damaged in the wafer polishing process, and when the thickness of the coating layer 215 is 0.5 mm or higher, pressure is non-uniformly applied to the edge and the wafer may thus be separated from the wafer support member.

The width ($w_2$) of the coating layer 215 may be greater than the width ($w_1$) of the rounded part of the support 210. That is, the coating layer 215 should be wider in order to protect the overall rounded part of the support 210.

The width ($W_1$) of the rounded part of the support 210 is about 3.0 mm and may be processed within a deviation of 10%. A ratio between the width ($W_1$) of the rounded epoxy glass and the width ($W_2$) of the coating layer 215 may be about 1:1.4 to 1:1.6.

Also, the inner thickness of the coating layer 215 is greater than the outer thickness thereof. This is the reason that the epoxy applied before drying and curing may flow out.

A template assembly, as one wafer support member, manufactured in the afore-mentioned process, is shown in FIG. 4D. The base substrate 220 is provided at a first surface thereof with an adhesive agent 223 and at a second surface thereof with a support 210 through an adhesive material 205. The edge of the support 210 is rounded and is provided with a coating layer 215.

The maximum thickness ($T_1$) of the coating layer 215 is about 0.5 mm and the coating layer 215 laminated on a non-rounded part of the support 210 may have a thickness ($T_2$) of about 0.1 mm to about 0.3 mm.

When the thickness ($T_2$) deviation of the coating layer 215 is not within ±0.1 mm, the coated solution may flow sideways.

The coating layer 215 thus obtained through the afore-mentioned process has a surface hardness of 82D or higher (based on a Brinell hardness tester). This surface hardness is required to allow the wafer support member to support the coating layer 215 until a wafer polishing process at 3,000 pcs is completed.

Hereinafter, mirror-polishing the wafer using the afore-mentioned wafer polishing unit will be illustrated.

The wafer surface may be mirror-polished by adhering a wafer to the wafer support member and applying pressure thereto in an expansion element 240. That is, pneumatic pressure is supplied from a pneumatic line 280 to the chamber 250, since the pneumatic line 280 passes through the back plate 270 and is connected to the chamber 250.

When the inner pressure of the chamber 250 increases, the expansion element 240 is isolated from the back plate 270 and the expansion element 240 applies pressure to the wafer support member 200.

Finally, the wafer support member 200 applies pressure to the wafer, the polishing process is performed while the wafer closely contacts a pad (not shown), and flatness of the wafer is improved through the polishing process.

In the afore-mentioned polishing process, the support 210 provided on the edge of the wafer support member 200 is rounded and the coating layer 215 is provided on the edge. Accordingly, the support 210 guides and supports the wafer such that the wafer is not separated from the polishing head in the wafer polishing process, and foreign materials are removed through the rounding and epoxy coating and scratches in the wafer surface are thus reduced in size or eliminated.

By varying the design of the wafer support member, for a 300 mm wafer, >37 nanometer PID defect percentage after a final polishing process can be decreased to about 2%. This value is lower than 25%, the defect percentate of conventional wafer support member not provided with an epoxy coating layer.

As apparent from the foregoing, a support provided on the edge of a wafer supporting portion is rounded and a coating layer is formed, thus preventing the wafer from being separated from a polishing head during polishing process and reducing scratches.

The wafer support member may be applied to a carrier in a double side polishing process of wafer.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A wafer support member, comprising:

a base substrate;

a support including at least two layers, the support being adhered at a predetermined width to the edge of the base substrate, the support having a round outermost part, the round outermost part extending between a top surface and a lateral side surface of the support such that an edge formed between the top and lateral side surface of the support is rounded; and a coating layer provided on a first portion of the support such that a second portion of the support is exposed, wherein the first portion of the support includes the round outermost part of the support, and wherein a curvature of the at least two layers at the round outermost part of the support is the same.

2. The wafer support member according to claim 1, wherein the coating layer is an epoxy coating layer.

3. The wafer support member according to claim 1, wherein the coating layer is composed of a mixture of epoxy and a polymer at a weight ratio of 2:1 to 4:1.

4. The wafer support member according to claim 1, wherein the coating layer is provided to a thickness of 0.2 to 0.5 mm on the outermost edge of the round support.

5. The wafer support member according to claim 1, wherein the coating layer is wider than the round part of the support.

6. The wafer support member according to claim 1, wherein a ratio of the width of the coating layer to the width of the round part of the support is 1.4:1 to 1.6:1.

7. The wafer support member according to claim 6, wherein the coating layer is further provided to a thickness of 0.1 to 0.3 mm in the non-round part of the support.

8. A wafer polishing unit, comprising:

a wafer support member to support a wafer;

a pressurizing unit to apply pressure to the wafer support member; and a pressure-supplying unit to supply pressure to the pressurizing unit, wherein the wafer support member includes a base substrate, a support adhered at a predetermined width to the edge of the base substrate, the support having a round outermost part and the support including at least two layers, the round outermost part extending between a top surface and a lateral side surface of the support such that an edge formed between the top and lateral side surface of the support is rounded, and a coating layer provided on a first portion of the support such that a second portion of the support is exposed, the first portion including the round outermost part of the support, wherein a curvature of the at least two layers at the round outermost part of the support is the same.

9. The wafer polishing unit according to claim 8, wherein the coating layer is an epoxy coating layer.

10. The wafer polishing unit according to claim 8, wherein the coating layer is composed of a mixture of epoxy and a polymer at a weight ratio of 2:1 to 4:1.

11. The wafer polishing unit according to claim 8, wherein the support is provided to a thickness of 0.2 to 0.5 mm on the outermost edge of the round support.

12. The wafer polishing unit according to claim 8, wherein the coating layer is wider than the round part of the support.

13. The wafer polishing unit according to claim 8, wherein a ratio of the width of the coating layer to the width of the round part of the support is 1:1.4 to 1:1.6.

14. The wafer polishing unit according to claim 13, wherein the coating layer is further provided to a thickness of 0.1 to 0.3 mm in the non-round part of the support.

* * * * *